US006053703A

United States Patent [19]

Kawaguchi et al.

[11] Patent Number: 6,053,703

[45] Date of Patent: Apr. 25, 2000

[54] CONTROL METHOD FOR DISPLACEMENT-TYPE FLUID MACHINE, AND APPARATUS THEREOF

[75] Inventors: Kyoji Kawaguchi; Akihiro Ushitora, both of Yokohama, Japan

[73] Assignee: Ebara Corporation, Tokyo, Japan

[21] Appl. No.: 09/048,344

[22] Filed: Mar. 26, 1998

Related U.S. Application Data

[63] Continuation-in-part of application No. 08/666,823, Jun. 19, 1996, abandoned.

[30] Foreign Application Priority Data

Jun. 19, 1995 [JP] Japan ..... 7-175429

[51] Int. Cl.[7] ..... F04B 49/06

[52] U.S. Cl. ..... 417/44.1; 318/807

[58] Field of Search ..... 417/44.1, 44.11, 417/45, 212; 62/228.4; 318/807

[56] References Cited

U.S. PATENT DOCUMENTS

| | | | |
|---|---|---|---|
| 4,147,473 | 4/1979 | Bufalov et al. | 417/53 |
| 4,186,334 | 1/1980 | Hirata | 318/805 |
| 4,511,312 | 4/1985 | Hartwig | 417/45 |
| 4,664,601 | 5/1987 | Uchida et al. | 417/27 |
| 4,678,404 | 7/1987 | Lorett et al. | 417/45 |
| 4,679,403 | 7/1987 | Yoshida et al. | 62/114 |
| 4,720,245 | 1/1988 | Takata et al. | 417/28 |
| 4,801,247 | 1/1989 | Hashimoto et al. | 417/213 |
| 5,263,335 | 11/1993 | Isono et al. | 62/228.4 |
| 5,486,106 | 1/1996 | Hehl | 425/145 |
| 5,563,490 | 10/1996 | Kawaguchi et al. | 417/44.1 |

FOREIGN PATENT DOCUMENTS

| | | |
|---|---|---|
| 0 100 390 | 2/1984 | European Pat. Off. . |
| 0 644 333 | 3/1995 | European Pat. Off. . |
| 0 652 374 | 5/1995 | European Pat. Off. . |
| 32 26 150 | 1/1984 | Germany . |
| 39 31 178 | 3/1991 | Germany . |

*Primary Examiner*—Erick R. Solis
*Assistant Examiner*—Arnold Castro
*Attorney, Agent, or Firm*—Wenderoth, Lind & Ponack, L.L.P.

[57] ABSTRACT

A method and an apparatus for controlling a displacement-type fluid machine which handles fluid including gas and/or liquid for increasing or decreasing pressure of the fluid or transporting the fluid including the use of an alternating current motor for driving the displacement-type fluid machine and a frequency converter which is capable of conducting frequency conversion up to a range higher than the power source frequency to adjust the number of revolutions of the motor. Wherein the number of revolutions is adjusted so that input current to the motor is kept constant, regardless of any change in operating pressure of the displacement-type fluid machine, whereby the displacement-type fluid machine is operated maintaining the process values within an allowable limit without effecting repeated actuation and stopping of the machine.

9 Claims, 7 Drawing Sheets

CONTROL METHOD FOR DISPLACEMENT-TYPE FLUID MACHINE, AND APPARATUS THEREOF

This is a Continuation-in-Part of Ser. No. 08/666,823, filed Jun. 19, 1996, which is abandoned.

BACKGROUND OF THE INVENTION

1. Field of the Art

The present invention relates to a control method and control apparatus for a displacement-type fluid machine to control the number of revolutions of a drive motor by means of an inverter or the like in operating a displacement-type fluid machine such as a Roots-type blower or a vane pump.

2. Prior Art

A displacement-type fluid machine for handling fluid such as a displacement-type pump is, for example, employed for lowering or decreasing pressure on an intake side of a displacement-type pump, increasing the pressure on a discharge side of the pump, or transporting liquid across the pump. A displacement-type pump is normally used together with a sealable container such as a tank, and processing values such as pressure and liquid level within the tank, etc., are detected and controlled so as to be within a predetermined range, by actuating or stopping the displacement pump. When an inverter or the like is employed to adjust the number of revolutions of the motor, the frequency is gradually increased or decreased to avoid abrupt acceleration or deceleration upon driving or stopping, or the number of revolutions is selected according to fluctuations in process values.

In a so-called ON/OFF control method, a displacement-type pump is actuated when an allowable limit of a process value is detected and the pump is stopped when a predetermined process value is detected. In this control method, however, the pump may be actuated too frequently depending on the operating conditions, resulting in damage to the motor and related equipment and a decrease in the working life of the equipment. In order to restrain the actuation frequency to within allowable times, a sealable container such as a tank must have sufficient capacity, which leads to increased facility costs. Further, since abrupt changes in process values are unavoidable in the ON/OFF control method, great fluctuations in the pressure or liquid level on the intake side or discharge side of the pump are caused, preventing stable operation of the system. Moreover, since the aforementioned control method greatly relies on detectors for detecting a pressure and liquid level, a proper operation of the apparatus is often prevented by the malfunctioning of these detectors.

The present invention has been made in the light of the aforementioned problems, and the object thereof is to provide a method and an apparatus for controlling a displacement-type fluid machine which enables the process values to be kept within an allowable limit without effecting repeated actuation and stopping of the pump.

SUMMARY OF THE INVENTION

In order to accomplish the object of the invention stated above, according to a first aspect of the invention, in a method for controlling a displacement-type fluid machine which handles fluid including gas and/or liquid for increasing or decreasing pressure of the fluid or transporting the fluids, the method comprises: the use of an alternating current motor for driving the displacement-type fluid machine; and the use of a frequency converter which is capable of conducting frequency conversion up to a range higher than the power source frequency to adjust the number of revolutions of the aforementioned motor; wherein the number of revolutions is adjusted so that an input current to the motor is kept constant, regardless of any change in operating pressure of the displacement-type fluid machine.

With frequency converters employing general-use inverters, the ratio V/f between a secondary voltage V and secondary frequency f is constant, but at frequencies higher than the power source frequency, the secondary voltage is limited by the power source voltage and consequently is the same value. Therefore, by controlling the primary current to be constant, the motor current becomes approximately constant above the power source frequency and the motor output becomes approximately constant.

When the demanded flow rate decreases and the input frequency to the motor drops below the power source frequency, the motor output torque becomes constant as the ratio V/f of the inverter is kept constant. As an inherent characteristic of the displacement-type fluid machine, when the torque is kept constant, the pressure generated is also kept constant. Therefore, even if the demanded flow rate decreases below the rated flow rate which corresponds to the power source frequency, the apparatus can be operated continuously while the pressure generated is kept constant. When the demanded flow rate further decreases and the input frequency reaches a predetermined minimum value which is allowed to the inverter and the motor, then, this value is detected and the motor is stopped. By this means, any inconvenience resulting from low revolutions such as a drop in efficiency or heating of the motor can be avoided.

According to a second aspect of the invention, in a method for controlling a displacement-type fluid machine according to the first aspect, an input current value to the motor is detected either within the frequency converter or at the primary or secondary side thereof, a current setting device is provided to set a constant current value according to the motor rating, and wherein input frequency to the motor is adjusted so that the input current value to the motor is maintained constant, based on an output signal from a comparator/adjuster device which compares the input current value with the set current value.

According to a third aspect of the invention, in a method for controlling a displacement-type fluid machine according to the first or second aspect, an upper limit is provided for the input frequency to the motor, whereby the number of revolutions of the motor and displacement-type fluid machine is maintained at a predetermined value or lower.

According to a fourth aspect of the invention, in a method for controlling a displacement-type fluid machine according to any of the first aspect to the third aspect, the motor and displacement-type fluid machine are stopped when the input frequency to the motor reaches a pre-determined minimum value, and the reduction in pressure difference or liquid level difference between the upstream side and downstream side of the displacement-type fluid machine is measured, and the motor and displacement-type fluid machine are actuated when the reduction reaches a predetermined value.

According to a fifth aspect of the invention, in an apparatus for controlling a displacement-type fluid machine which handles fluid including gas and/or liquid for increasing or decreasing pressure of the fluid or transporting the fluids, the aforementioned apparatus comprises: an alternating current motor for driving the displacement-type fluid machine; a frequency converter which is capable of conducting frequency conversion up to a range higher than the power source frequency to adjust the number of revolutions of said motor; and control means for adjusting the number of revolutions of the motor so that input current to the motor is constant, regardless of any change in operating pressure of the displacement-type fluid machine.

According to a sixth aspect of the invention, in an apparatus for controlling a displacement-type fluid machine according to the fifth aspect, the apparatus further comprises: means for detecting the input current value to the motor either within said frequency converter or at the primary or secondary side thereof, a current setting device for setting a constant current value according to the motor rating; and a comparator/adjuster device which compares the input current value with the constant current value set at the current setting device; wherein the control means adjusts input frequency to the motor so that the input value to the motor is maintained constant based on the output signal of the comparator/adjuster device.

According to a seventh aspect of the invention, in an apparatus for controlling a displacement-type fluid machine according to the fifth or sixth aspect, means for providing an upper limit for the input frequency to the motor is provided, thereby maintaining the number of revolutions of the motor and displacement-type fluid machine at a predetermined value or lower.

According to eighth aspect of the invention, in an apparatus for controlling a displacement-type fluid machine according to a fifth to seventh aspect, the apparatus further comprises: means for stopping the motor and displacement-type fluid machine when the input frequency to the motor reaches a predetermined minimum value, and means for measuring the reduction in pressure difference or liquid level difference between the upstream side and downstream side of the displacement-type fluid machine, and actuating the motor and displacement-type fluid machine when the reduction reaches a predetermined value.

The aforementioned displacement-type fluid machine may comprise a two-lobe or three-lobe Roots-type vacuum pump or compressor, gear pump, rotary vane-type pump or compressor, water sealing vacuum pump or compressor, reciprocating liquid pump or compressor, or reciprocating vacuum pump.

With the arrangement according to the invention, because the number of revolutions is adjusted so that the input current to the drive motor of the displacement-type pump is kept constant regardless of any change in operating pressure of the displacement-type pump, when the operating difference pressure or operating pressure of the displacement-type pump decreases and the required motive power decrease, the number of revolutions is increased, and thus the intake flow rate increases proportionally. On the other hand, when the operating pressure of the displacement-type pump increases and the required motive power increases, the number of revolutions is decreased so as to maintain the input current to the motor at a constant level, and thus the intake flow rate decreases proportionally.

In general, the maximum operating pressure and flow rate of the displacement-type pump driven by an alternating current motor is achieved at the rated number of revolutions at the power source frequency. However, the operation stated above can be realized by means of a frequency converter which is capable of conducting frequency conversion up to a range higher than the power source frequency, to enable the motor speed to be increased even when the operating pressure is decreased.

By selecting the capacity of the displacement-type pump around the average value with time for the fluctuating demand, the displacement-type pump is not actuated and stopped repeatedly, but is rather continuously driven in such a way that the number of revolutions is increased or decreased according to fluctuation on demand, resulting in a simple control mechanism and lower cost.

An apparatus including a displacement-type pump is actuated either manually or automatically upon detection of a value lower than the predetermined operating pressure difference or liquid level difference across the displacement-type pump. However, because the pressure or liquid level exerts little load on the displacement-type pump upon actuation, the number of revolutions of the motor and the flow rate are increased rapidly in the early operating stage, thereby providing a predetermined pressure and liquid level in a short time.

When the input current value to the motor is detected either within the frequency converter or at the primary or secondary side thereof, and a comparator/adjuster device compares the input current value with a constant current value set at the current setting device, it is possible to maintain an input value to the motor at the constant current value based on the motor rating.

When an upper limit is provided for the input frequency signal, it is possible to prevent an excessive increase in the number of revolutions.

And when a lower limit is provided for the aforementioned input frequency signal, it is possible to prevent an excessive load by detecting this lower limit and stopping the drive motor.

The above and other objects, features and advantages of the present invention will become more apparent from the following description when taken in conjunction with the accompanying drawings in which preferred embodiments of the present invention are shown by way of illustrative examples.

PREFERRED EMBODIMENTS OF THE INVENTION

Figure 1:
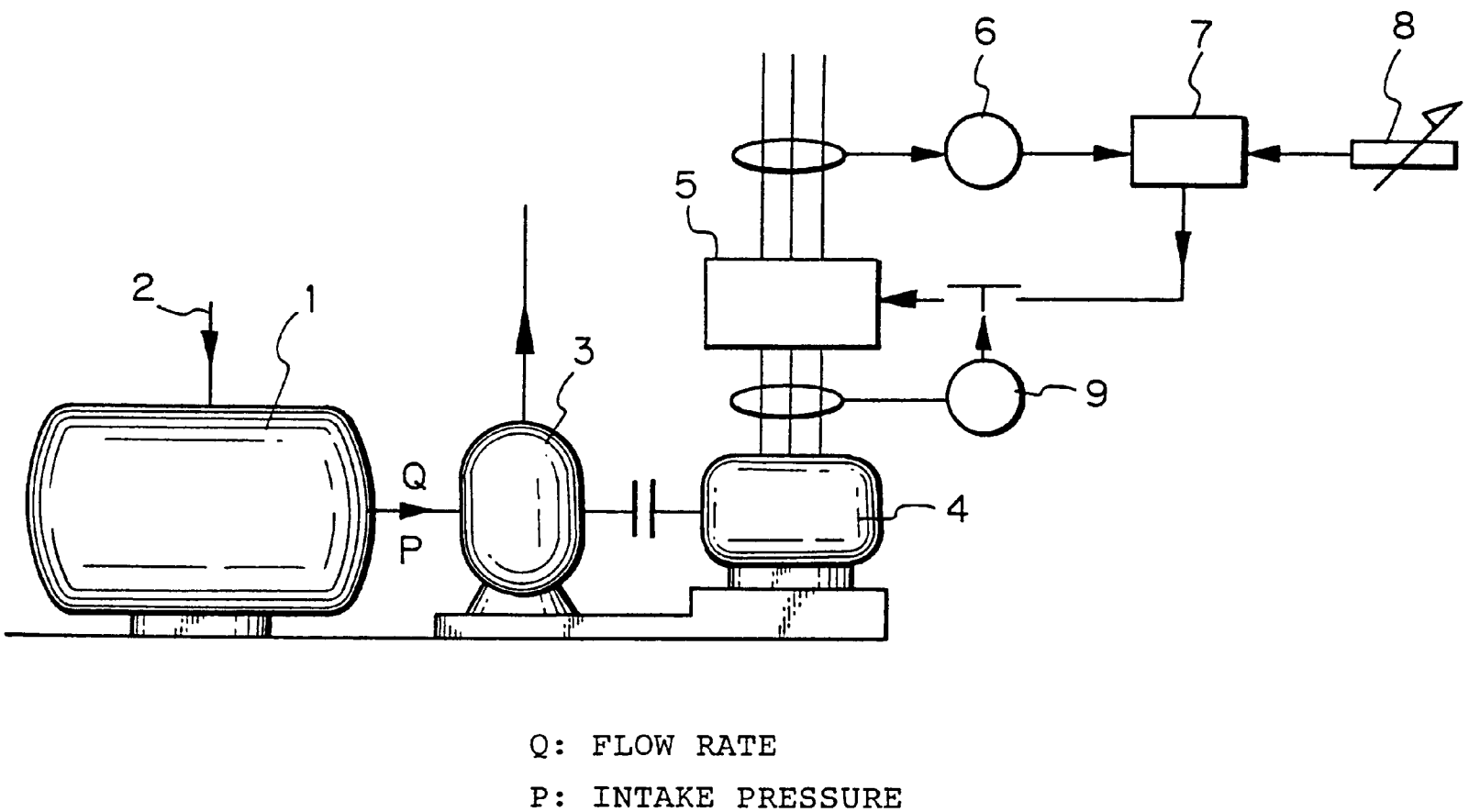
FIG. 1 is a block diagram illustrating the control apparatus of the displacement-type pump of the first embodiment of the present invention.

FIG. 1 illustrates a first embodiment of the present invention applied to a vacuum blower for a vacuum-type sewage collection system. This system is provided with a vacuum tank 1 at a vacuum pumping station, and effects continuous collection of sewage via connected piping 2 by maintaining the tank under a vacuum state.

An alternating current motor 4 which drives the vacuum blower 3 is supplied with electrical power from an inverter (frequency converter) 5. A current detector 6 is provided at the primary side of the inverter 5, and the detected current is input to a comparator/adjuster device 7. On the other hand, a signal from a current setting device 8 which sets the current value according to the rating of the motor 4 is compared with the detected current value in the comparator/adjuster device 7, from which a frequency increase/decrease signal based on the deviation of the above comparison is input to the frequency setting portion of the inverter 5, thereby increasing or decreasing the number of revolutions of the motor 4, i.e., the vacuum blower 3. The reference numeral 9 denotes a frequency detector for measuring the secondary side frequency of the inverter 5, which can be used for setting the upper limit of frequency.

Figure 2:
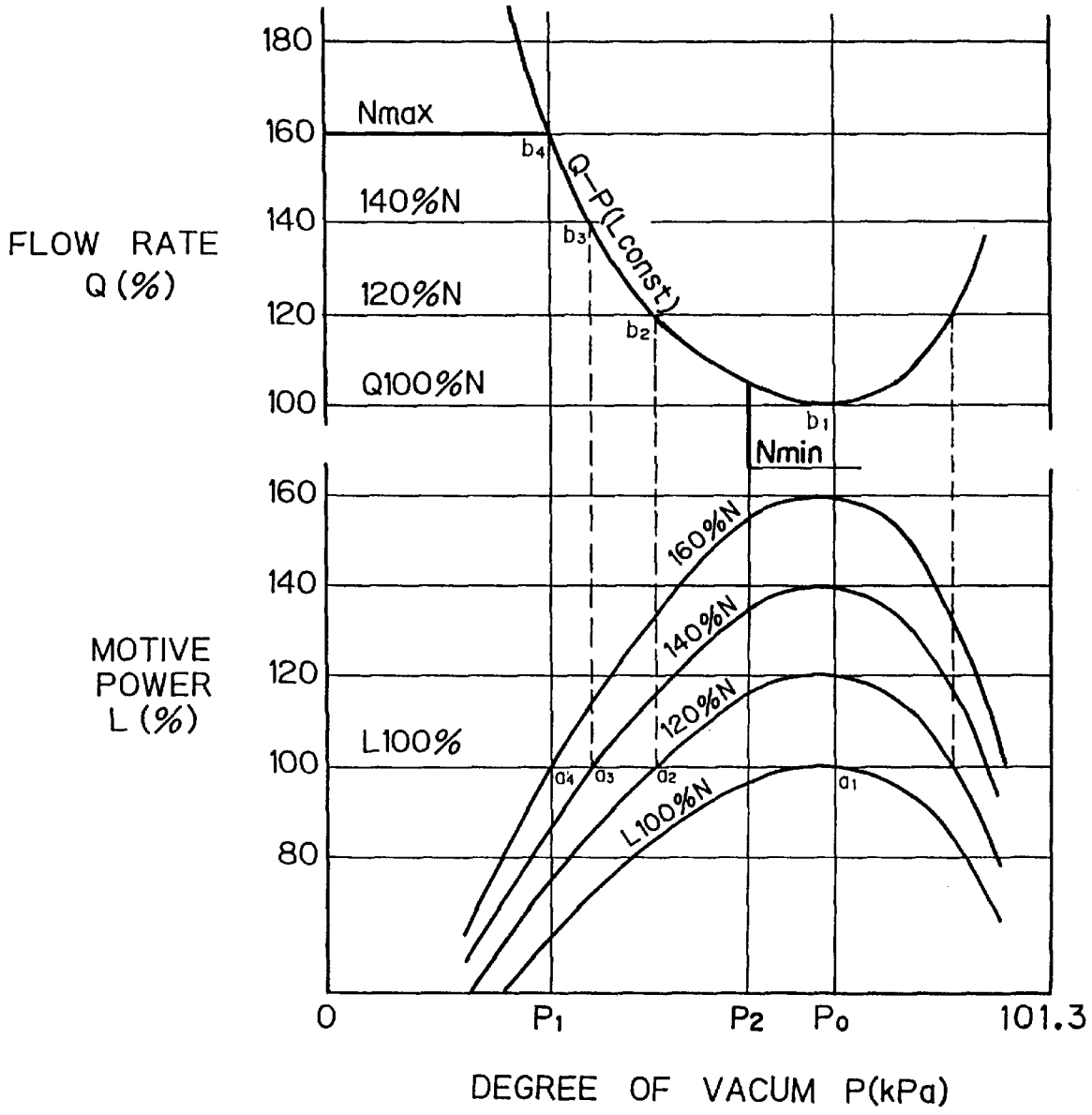
FIG. 2 is a graph illustrating the performance of the displacement-type pump according to the control method of the first embodiment of the present invention.

FIG. 2 is a diagram describing the change in performance of the vacuum blower 3 shown in FIG. 1 in the event that the input current to the motor 4 is controlled so as to be a constant value. This figure illustrates the theoretical performance of a displacement-type pump when it is operated at different numbers of revolutions. Namely, when the theoretical flow rate Q at each constat number of revolutions of the motor is represented by the ordinate in the upper half of FIG. 2, and the degree of vacuum P is represented by the abscissa, the flow rate of the displacement-type pump is proportional to the number of revolutions, and the flow rate at each of the number of revolutions is a constant value as represented by horizontal lines Q 100% N, 120% N, . . . On the other hand, the required motive power changes according to the degree of vacuum P. The required motive power is represented as being 100% when the rated flow under the rated number of revolutions is taken to be 100% and the rated degree of vacuum is taken to be $P_o$ at which the required motive power reaches a maximum. When the operation of the vacuum pump is taken to be adiabatic compression, the required theoretical motive power at each of the number of revolutions regarding the degree of vacuum P is represented by a group of curves; L 100% N, 120% N . . . The points of intersection a1, a2, a3 . . . between these curves and the horizontal line L100% representing constant motive power indicate degrees of vacuum which provide a constant value of 100% theoretical motive power at each of the number of revolutions. The flow rate corresponding to these degrees of vacuum at each number of revolutions can be obtained from the points of intersection b1, b2, b3 . . . between these degrees of vacuum and the horizontal lines of the flow Q100%, 120% . . . corresponding to each number of revolutions. Thus, by controlling the number of revolutions of the motor so that the primary current to the motor or the input motive power to the motor is made constant under a constant power source voltage, the pump exhibits flow rate to vacuum degree properties as indicated by the curved line Q-P (L const) in the figure.

Although in FIG. 2, the adiabatic efficiency of the vacuum pump and the mechanical efficiency are taken as being constant, and further, the efficiency of the motor and inverter are also taken as being constant, the fluctuations of these efficiencies in a practical apparatus are relatively small even when the number of revolutions or degree of vacuum fluctuates, so that the relation between the degree of vacuum P and flow rate Q under a constant input motive power indicates a tendency shown by the curve of Q-P (L const). As can be clearly seen from FIG. 2, when the degree of vacuum P drops, i.e., when the intake absolute pressure increases, the motor power source frequency, i.e., the number of revolutions, increases so that the input current is kept at constant value and the intake flow rate is remarkably increased. For example, in FIG. 2, when the degree of vacuum reaches $P_1$, the number of revolutions increases to 160% of the rated revolution number and the flow rate is increased accordingly.

Conventionally, with vacuum sewage collection systems, etc., the vacuum pump is operated at a constant speed, and when the degree of vacuum drops to an intermediate degree of vacuum such as $P_1$, the pump is actuated, and when the degree of vacuum reaches the maximum $P_0$, the pump is stopped, thereby repeating this actuation and stopping. The vacuum tank pressure is normally operated at a value between the maximum degree of vacuum $P_0$, and an intermediate degree of vacuum $P_1$. In this invention, by setting the vacuum pump capacity to a predetermined air capacity which is most frequently used, and by controlling the number of a revolutions so that the required motive power is kept at constant value, the vacuum pump is not needed to be turned on and turned off during this process, but can be continuously operated at a number of revolutions corresponding to the degree of vacuum. Further, a conventional vacuum tank having a great capacity to avoid the frequent actuation of the vacuum pump is not needed.

Since the degree of vacuum of the vacuum tank is low when starting up the facilities, the vacuum pump operates at a high speed, thereby obtaining the predetermined degree of vacuum in a short time. Subsequently, continuous operation is maintained while the number of revolutions is automatically adjusted according to demand. The vacuum pump may be arranged in such a way that the maximum degree of vacuum $P_0$ is detected and the pump is shut down when the facilities are inoperative, such as at night, and the pump is actuated by detecting the intermediate degree of vacuum $P_1$, upon start-up of the facilities.

In order to prevent an excessive increase in speed of the vacuum pump when the degree of vacuum in the vacuum tank is low, by detecting the frequency at the secondary side of the inverter 5, and by setting an upper limit in the frequency detector 9, the vacuum pump can be operated at all times at a number of revolutions which is within an allowable limit.

In the case of a vacuum pump, when the pressure exceeds the maximum degree of vacuum $P_0$, the required motive power again decreases and the pump speed is again increased. Thus, when the low rate decreases, it is necessary to stop the motor at a predetermined frequency which corresponds to the maximum degree of vacuum $P_0$ by detecting the predetermined frequency. In order to maintain continuous operation of the machine without stopping the vacuum pump even when the demanded flow rate decreases, the pump characteristics should be so selected that the input frequency becomes the power source frequency at a vacuum degree $P_2$ which is lower than the maximum vacuum degree $P_0$. By this, the pump can be operated continuously under a constant torque at vacuum pressure $P_2$. In this case also, the vacuum pump is stopped at a predetermined allowable lowermost frequency. In this way, the pump can be operated continuously over a wide range of the demanded flow rate.

Figure 3:
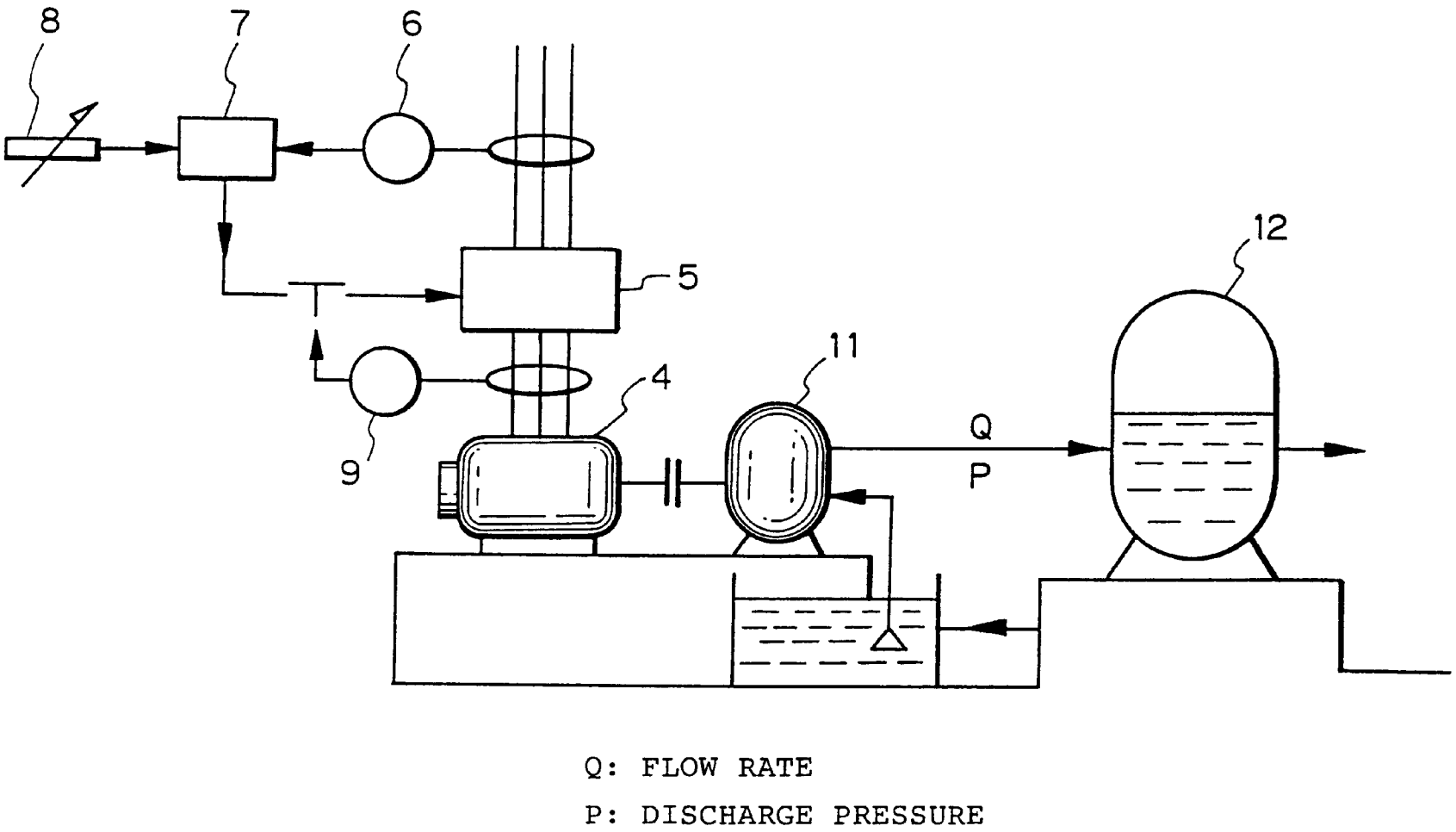
FIG. 3 is a block diagram illustrating the control apparatus of the displacement-type pump of the second embodiment of the present invention.

As a second embodiment, FIG. 3 illustrates an apparatus which pressurizes fluid and accumulates the pressurized fluid in a pressure tank 12 by means of a displacement-type liquid pump 11, for applying the pressurized fluid to various processing. Automatic ON/OFF operation of the pressure-oil pump 11 is generally conducted to maintain the pressure or liquid level in the pressure tank within a predetermined range.

Figure 4:
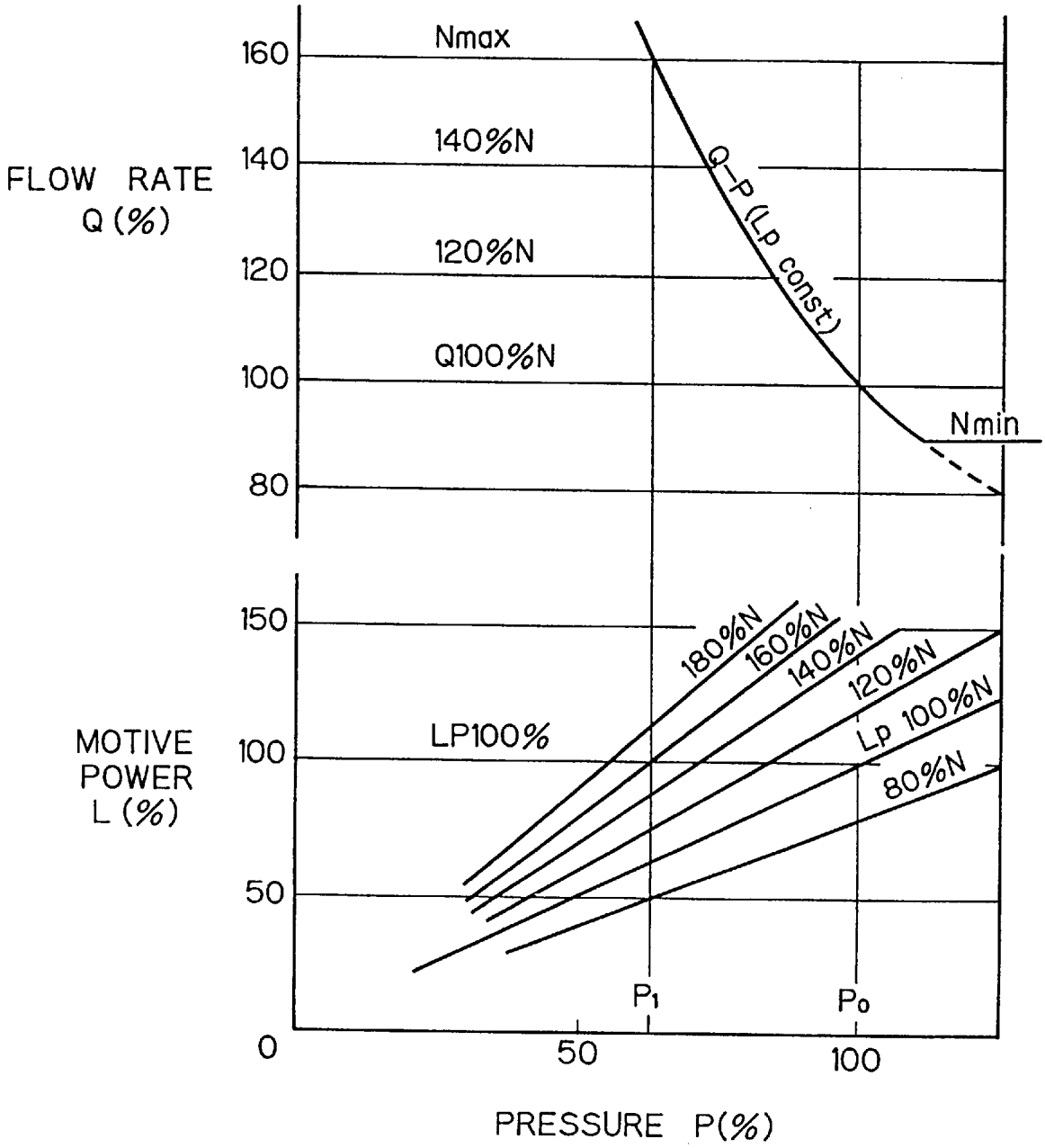
FIG. 4 is a graph illustrating the performance of the displacement-type pump according to the control method of the second embodiment of the present invention.

FIG. 4 illustrates a theoretical performance of the displacement-type liquid pump when it is controlled in the apparatus shown in FIG. 3. At rated-speed operation, the flow rate Q is constant regarding the operating pressure P and is represented by a horizontal line Q (100% N). The required motive power $L_p$ at rated speed operation increases proportionally to the pressure P and is represented by a straight line $L_p$, 100% N.

By controlling the number of revolutions so that the input current to the displacement-type pump driving motor is kept at a constant level according to the present invention, the relation between the flow rate and operating pressure becomes such as that represented by the curve Q-P ($L_p$ const). Consequently, the number of revolutions is increased with a drop in operating pressure, and the flow rate is remarkably increased. An upper limit Nmax is set for the number of revolutions.

Figure 7A:
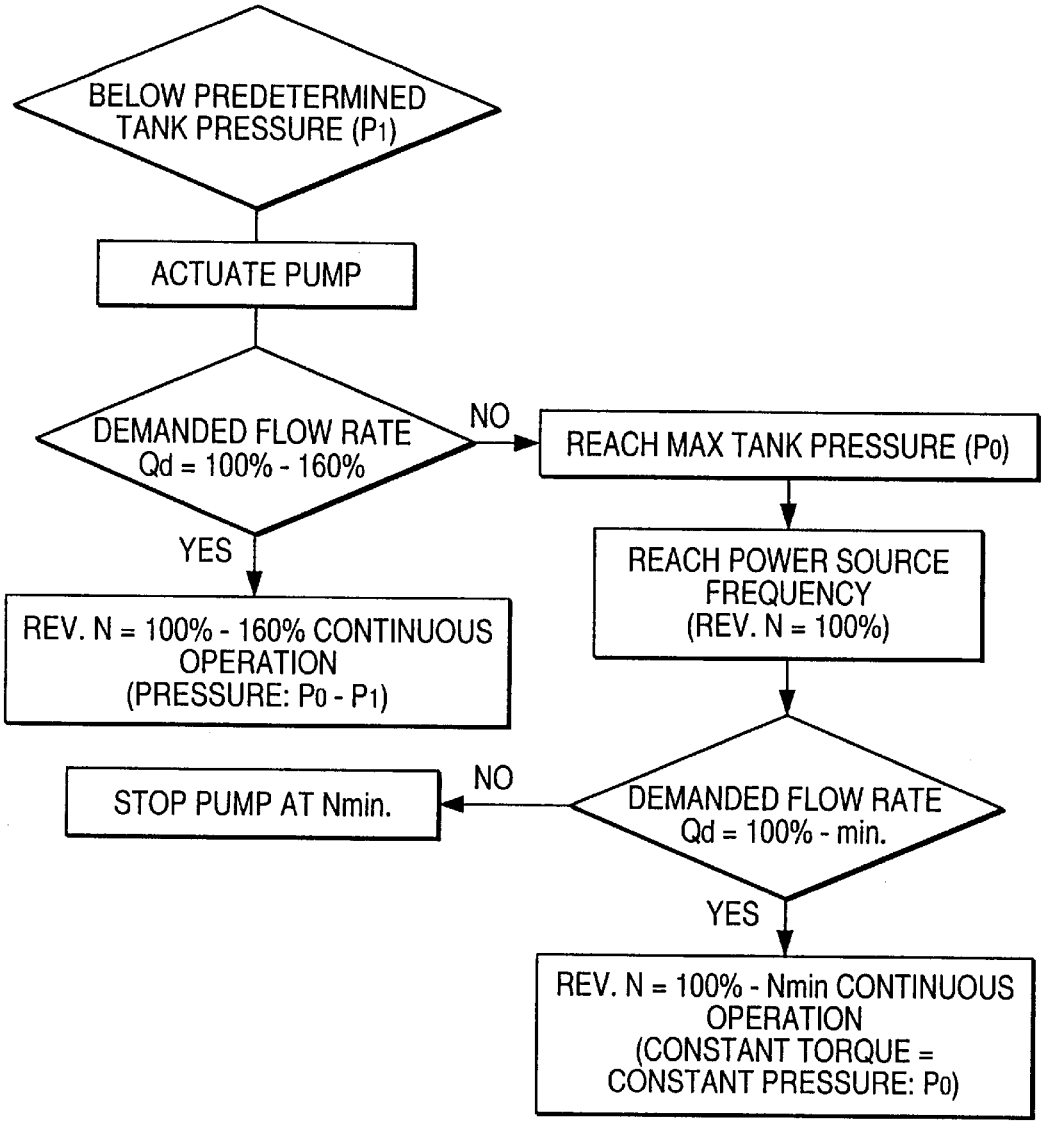
FIGS. 7(*a*) and 7(*b*) illustrate an operational pump control of the present invention.
Figure 7B:
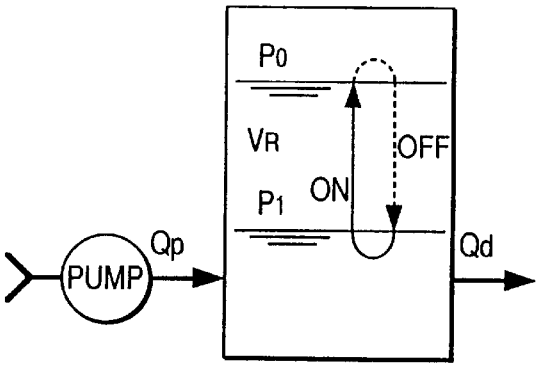

Upon starting up the apparatus, the displacement-type pump 11 is actuated after having detected pressure $P_1$ or lower. Since the flow rate after actuation of the pump is great, the pressure or liquid level of the predetermined level can be attained in a short period. While the demanded flow rate is within 160%–100%, since the pumped flow rate keeps balance with the demanded flow rate, the pump is continuously operated at a pressure corresponding to the demanded flow rate while motor input being kept constant. When the demanded flow rate decreases below 100%, the input frequency to the motor decreases below the power source frequency and the pump is operated continuously while the torque is kept constant or the pressure is kept constant at pressure $P_0$. When the demanded flow rate further decreases and the frequency reaches the lowermost value of the input frequency, then the pump is stopped. In this way, the pump can be operated continuously over a wide range of demanded flow rate from its minimum to maximum value, e.g. 20% to 160%. Therefore, the pressure tank having a great capacity, which was needed to cope with the frequent activation of the vacuum pump in the conventional ON/OFF operation under the fixed motor speed becomes unnecessary. This operational control is shown in FIGS. 7(*a*) and 7(*b*).

Figure 5:
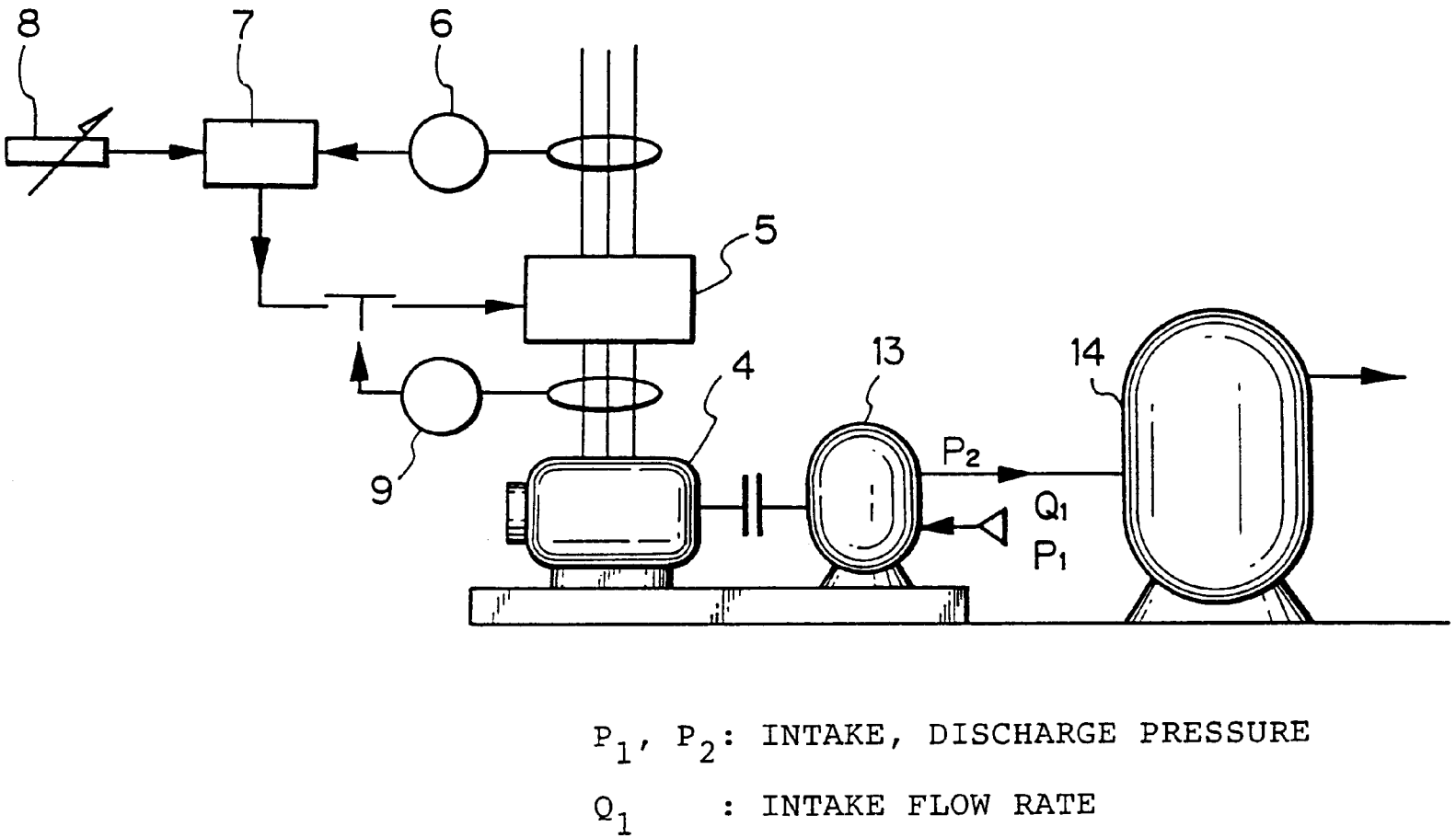
FIG. 5 is a block diagram illustrating the control apparatus of the displacement-type pump of the third embodiment of the present invention.
Figure 6:
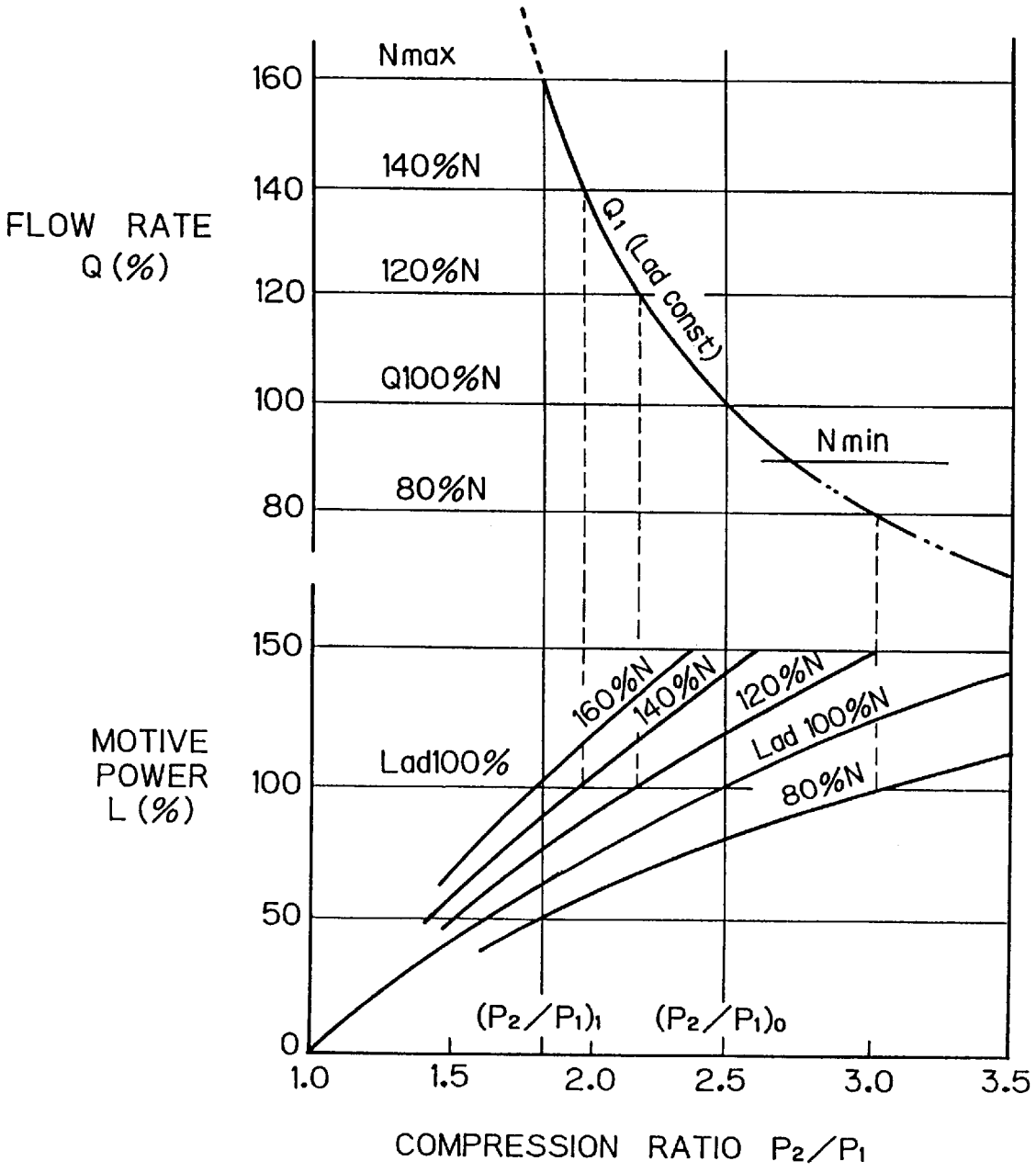
FIG. 6 is a graph illustrating the performance of the displacement-type pump according to the control method of third embodiment of the present invention.

As a third embodiment, FIG. 5 illustrates an apparatus which pressurizes gas and accumulates pressure in a pressure tank 14 by means of a displacement-type compressor 13, for applying the pressurized gas to various processing. FIG. 6 illustrates a theoretical performance of an adiabatic compression of the displacement-type compressor with a rated compression ratio of $P_2/P_1$=2.5. When the apparatus is operated at the set speed or rated speed, the intake flow rate $Q_1$ is constant regarding the operating compression ratio $P_2/P_1$, and is represented by a horizontal line $Q_1$ 100% N. On the other hand, the required motion power Lad increases with the compression ratio $P2/P_1$, and is represented by a curve Lad 100% N.

By controlling the number of revolutions so that an input current to the motor driving the displacement-type compressor is kept constant according to the present invention, the relation between the intake flow rate and the compression ratio is represented by a curve $Q_1$ (Lad const), so that the intake flow rate is remarkably increased with a decrease of the compression ratio. An upper limit Nmax of the number of revolutions is set in the frequency detector 9, which detects the frequency of the secondary side of the frequency converter apparatus, and limits the speed of the motor.

During operation of the apparatus, when the demanded flow rate is within the range 160%–100%, the motor input is kept constant and the compressor can be operated in continuous basis between $(P_2/P_1)_0$–$(P_2/P_1)_1$. When the demanded flow rate becomes below 100%, the compressor is operated continuously while the motor torque or the compression ratio $(P_2/P_1)_0$ being kept constant. Further, when the minimum number of revolutions Nmin is detected from the input frequency to the motor, the motor is stopped.

As described above, according to the present invention, by controlling the number of revolutions of a displacement-type machine so that the input electrical power to the drive motor of a pump is made constant, it is possible to continuously operate the pump unit in an automatic manner according to the operating pressure or liquid level, and to exhibit the utmost capability as a pump unit including a drive motor. Also, while relatively large-scale pressure or decompression containers were needed in the conventional ON/OFF operation to restrain the actuation frequency of the machinery within a allowable limit, with the present invention such large-scale containers are unnecessary or can be made quite small. Further, when starting up the apparatus, the number of revolutions is increased to the upper limit of mobile power, so that the pressure, vacuum level, liquid level, compression ratio, etc. created by the displacement-type machine can be increased to a usable level in a short period. Moreover, continuous operation is made possible according to demand while avoiding excessive activation and stopping, by selecting the rated capacity of the displacement-type machine to be compatible to the demand.

Further, since the displacement-type machine is operated while motor torque or pressure generated being kept constant a wide range of the demanded flow rate below the power source frequency, it is possible to avoid excessive pressure rise above the predetermined value and it is, therefore, possible to preserve the safety of the machine.

What is claimed is:

1. A method for controlling a displacement-type fluid machine which handles fluid including gas and/or liquid for increasing or decreasing pressure of fluid or transporting fluid, said method comprising:

providing an alternating current motor for driving the displacement-type fluid machine; and providing a frequency converter which is capable of conducting frequency conversion up to a range higher than the power source frequency to adjust the number of revolutions of said motor;

wherein the number of revolutions is adjusted so that an input current to the motor is kept constant, regardless of any change in operating pressure of said displacement-type fluid machine, wherein said motor and displacement-type fluid machine are stopped when the input frequency to said motor reaches a predetermined minimum value, and the reduction in pressure difference or liquid level difference between the upstream side and downstream side of the displacement-type fluid machine is measured, and the motor and displacement-type fluid machine are actuated when said reduction reaches a predetermined value.

2. A method for controlling a displacement-type fluid machine according to claim 1, wherein the input current value to said motor is detected either within said frequency converter or at the primary or secondary side thereof, a current setting device is provided so as to set a constant current value according to the motor rating, and wherein input frequency to said motor is adjusted so as to maintain the input value to said motor constant, based on the output of a comparator/adjuster device which compares said input current value and set current value.

3. A method for controlling a displacement-type fluid machine according to claim 1, wherein an upper limit is provided for said input frequency to said motor, thereby maintaining the number of revolutions of said motor and displacement-type fluid machine to a predetermined value or lower.

4. An apparatus for controlling a displacement-type fluid machine which handles fluid including gas and/or liquid for increasing or decreasing pressure of the fluid or transporting the fluid, said apparatus comprising:

an alternating current motor for driving the displacement-type fluid machine;

a frequency converter which is capable of conducting frequency conversion up to a range which is higher than the power source frequency to adjust the number of revolutions of said motor;

control means for adjusting the number of revolutions so that input current to said motor is constant, regardless of change in operating pressure of said displacement-type fluid machine;

means for stopping said motor and displacement-type fluid machine when the input frequency to said motor reaches a predetermined minimum value; and means for measuring the reduction in pressure difference or liquid level difference between the upstream side and downstream side of said displacement-type fluid machine, and actuating said motor and displacement-type fluid machine when said reduction reaches a predetermined value.

5. An apparatus for controlling a displacement-type fluid machine according to claim 4, further comprising:

means for detecting the input current value to said motor either within said frequency converter or at the primary or secondary side thereof, a current setting device for setting a constant current value according to the motor rating; and a comparator/adjuster device which compares said input current value with the constant current value set at said current setting device;

wherein said control means adjusts an input frequency to said motor so that the input value to said motor is maintained constant based on the output signal of said comparator/adjuster device.

6. An apparatus for controlling a displacement-type fluid machine according to claim 4, further comprising means for providing an upper limit for input frequency to said motor thereby maintaining the number of revolutions of said motor and displacement-type fluid machine to a predetermined value or lower.

7. An apparatus for controlling a displacement-type fluid machine according to claim 4, wherein said displacement-type fluid machine comprises one of a two-lobe or three-lobe Roots-type vacuum pump or compressor, a gear pump, a rotary vane-type pump or compressor, a water-ring vacuum pump or compressor, a reciprocating liquid pump or compressor, or a reciprocating vacuum pump.

8. An apparatus for controlling a displacement-type fluid machine according to claim 5, wherein said displacement-type fluid machine comprises one of a two-lobe or three-lobe Roots-type vacuum pump or compressor, a gear pump, a rotary vane-type pump or compressor, a water-ring vacuum pump or compressor, a reciprocating liquid pump or compressor, or a reciprocating vacuum pump.

9. An apparatus for controlling a displacement-type fluid machine according to claim 6, wherein said displacement-type fluid machine comprises one of a two-lobe or three-lobe Roots-type vacuum pump or compressor, a gear pump, a rotary vane-type pump or compressor, a water-ring vacuum pump or compressor, a reciprocating liquid pump or compressor, or a reciprocating vacuum pump.

* * * * *